US006694703B1

(12) United States Patent
Grossmann et al.

(10) Patent No.: US 6,694,703 B1
(45) Date of Patent: Feb. 24, 2004

(54) METHOD OF AND APPARATUS FOR ACCUMULATING AND JOINING BLANKS OF PACKETS FOR BLOCK-SHAPED GROUPS OF ARTICLES

(75) Inventors: Jürgen Grossmann, Hamburg (DE); Frank Bley, Hamburg (DE); Josef Glösmann, Hamburg (DE); Michael Kleine Wächter, Juliusburg (DE)

(73) Assignee: Topack Verpackungstechnik GmbH, Schwarzenbek (DE)

( * ) Notice: Subject to any disclaimer, the term of this patent is extended or adjusted under 35 U.S.C. 154(b) by 0 days.

(21) Appl. No.: 09/010,166

(22) Filed: Jan. 21, 1998

(30) Foreign Application Priority Data

Jan. 29, 1997 (DE) ..... 197 03 069

(51) Int. Cl.[7] ..... B65B 11/06
(52) U.S. Cl. ..... 53/228; 53/232; 53/586
(58) Field of Search ..... 53/228, 232, 234, 53/586, 233, 466

(56) References Cited

U.S. PATENT DOCUMENTS 4,084,393 A * 4/1978 Focke ..... 53/136.4
4,843,798 A * 7/1989 Focke et al. ..... 53/453
5,163,268 A * 11/1992 Vaccari et al. ..... 53/397
5,261,209 A * 11/1993 Focke et al. ..... 53/410
5,353,815 A * 10/1994 Gamberini et al. ..... 131/283
5,600,935 A * 2/1997 Isani et al. ..... 53/234
5,755,080 A * 5/1998 Draghetti et al. ..... 53/466
5,822,948 A * 10/1998 Manservigi et al. ..... 52/466
6,047,529 A * 4/2000 Draghetti ..... 53/466
6,213,925 B1 * 4/2001 Georgitsis et al. ..... 493/80

* cited by examiner

*Primary Examiner*—Eugene Kim
(74) *Attorney, Agent, or Firm*—Venable LLP; Robert Kinberg; Chad C. Anderson

(57) ABSTRACT

Blanks for conversion into hinged-lid packets for block-shaped arrays of cigarettes in metal foil envelopes are supplied by a first turntable to an assembling station where successive blanks are overlapped by successive arrays furnished by a second turntable. Each blank is draped around the envelope of the respective array in part at the assembling station and in part at a further station downstream of the assembling station, as seen in the direction of joint advancement of the arrays and the corresponding blanks toward an evacuating station. Each array is moved at the assembling station vertically downwardly from a pocket of the second turntable into a pocket of the first turntable; the latter thereupon advances the arrays and the blanks jointly to the further station, and the finished packets—with the arrays confined therein—to the evacuating station.

8 Claims, 12 Drawing Sheets

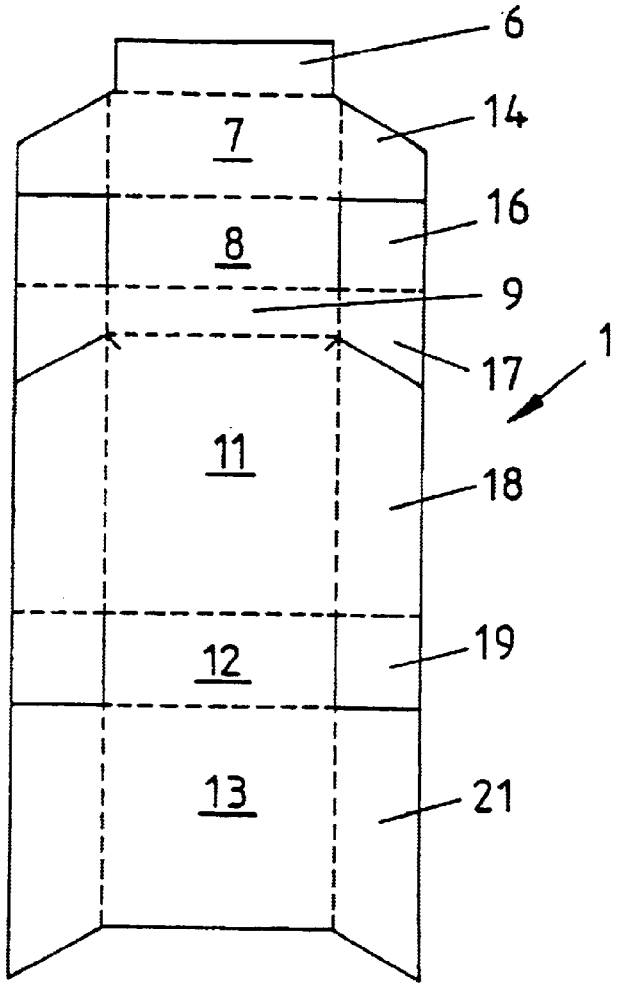
Fig.5a
Fig.5b
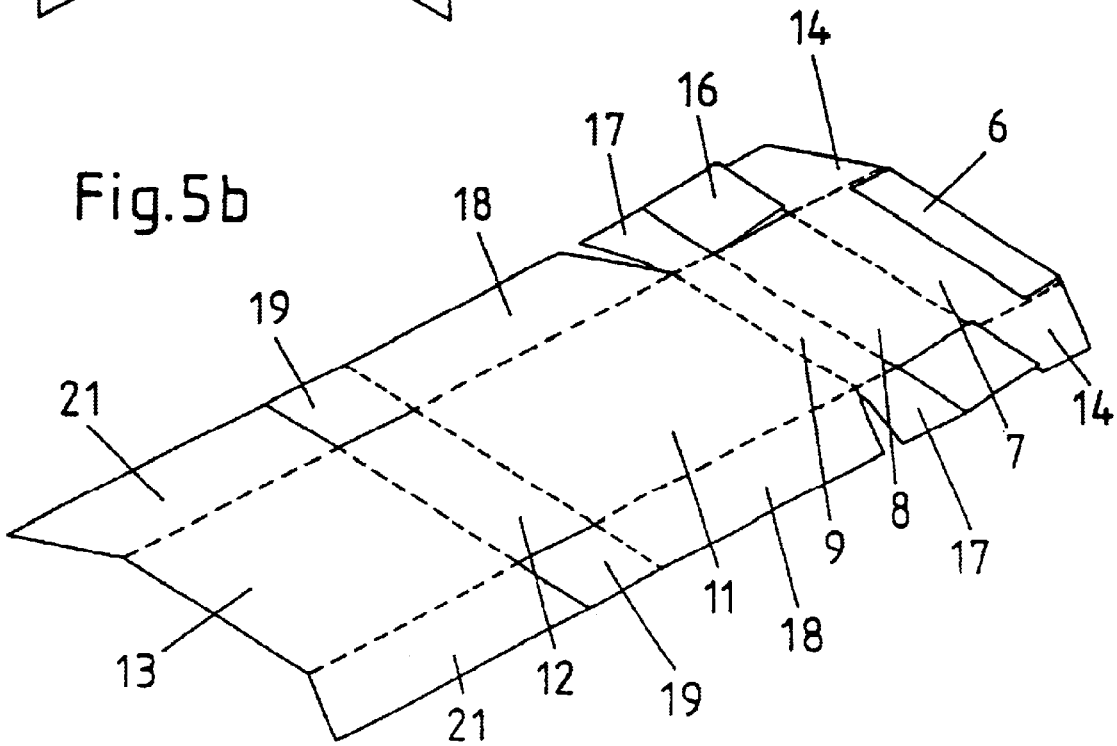

14
16
6
7
17
18
8
19
11
21
14
16
12
17
9
13
18
19
21

14
16
6
14
17
7
18
19
8
21
11
16
17
12
9
18
13
19
21

METHOD OF AND APPARATUS FOR ACCUMULATING AND JOINING BLANKS OF PACKETS FOR BLOCK-SHAPED GROUPS OF ARTICLES

BACKGROUND OF THE INVENTION

The invention relates to improvements in methods of and in apparatus for converting prefabricated blanks into receptacles or containers, such as packets for arrays of cigarettes or other smokers' products. More particularly, the invention relates to improvements in methods of and in apparatus for converting prefabricated blanks into receptacles or packets as a result of selective deformation of normally flat or substantially flat blanks directly around the commodities which are to be confined in the thus obtained or shaped receptacles or containers. Still more particularly, the invention relates to improvements in methods and in apparatus which can be utilized with advantage, but not necessarily exclusively, for the making of so-called hinged-lid packets for substantially block-shaped arrays of plain or filter cigarettes.

A so-called hinged-lid packet normally confines a block-shaped array of (for example, twenty) plain or filter cigarettes or other rod-shaped smokers' products (hereinafter called cigarettes for short) which is confined in an inner envelope normally consisting of metallic foil (such as aluminum foil). The packet can be made of cardboard or a relatively rigid plastic material and is designed and dimensioned to tightly re-receive and confine the inner envelope and the full array of normally twenty cigarettes. As a rule, or at least in many instances, the hinged-lid packet comprises a substantially U-shaped insert of cardboard or the like; such insert is confined in and engaged by the pivotable top portion or lid when the latter is pivoted to its closed position. In order to gain access to cigarettes, the purchaser must pivot the lid to its open position and must remove the then accessible top portion of the inner envelope; such top portion is surrounded by and extends outwardly beyond the aforementioned U-shaped inlet of the packet.

As concerns the making and the manipulation of the inserts for use in hinged-lid packets for cigarettes or the like, reference may be had to the commonly owned copending U.S. patent application Ser. No. 08/780,744 filed Jan. 8, 1997 by Nikolaos Georgitsis and Nils Rose for "Method of and apparatus for transferring cigarette packet blanks into the receptacles of a conveyor". If and when allowed, the disclosure of this copending patent application will be incorporated herein by reference.

OBJECTS OF THE INVENTION

An object of the invention is to provide a simple but reliable method of assembling convertible blanks and commodities to be confined in converted blanks in a highly predictable manner and at a rate which is required in a modern machine for the mass production of cigarette packets or the like.

Another object of the invention is to provide a novel and improved method of advancing blanks which are to be converted into receptacles, and commodities which are to be confined in such receptacles relative to as well as with each other toward and thereupon through a series of packet forming stations.

A further object of the invention is to provide a method which can be resorted to with particular advantage for the making of so-called hinged-lid packets, for example, for block-shaped arrays of smokers' products such as plain or filter cigarettes.

An additional object of the invention is to provide a method which can be resorted to for the manipulation of block-shaped commodities and convertible blanks in single-track or multiple-track (such as dual-track) packing machines for cigarettes or the like.

Still another object of the invention is to provide a novel and improved method of pivoting and/or otherwise folding various sections (such as panels and flaps including tucks) of each of a series of successive blanks in a predetermined sequence, in predetermined directions and to a predetermined extent in order to convert the blanks into receptacles for block-shaped commodities such as arrays of plain or filter cigarettes.

A further object of the invention is to provide a novel and improved apparatus for the practice of the above outlined method.

Another object of the invention is to provide the apparatus with novel and improved means for transporting the constituents of hinged-lid packets or analogous receptacles and their contents with and relative to each other.

An additional object of the invention is to provide the above outlined apparatus with novel and improved means for draping blanks around commodities in a highly predictable manner and in such a way that the appearance of each of a short or long series of finished receptacles will be the same.

Still another object of the invention is to provide the above outlined apparatus with novel and improved means for completing the draping of blanks around substantially block-shaped commodities in a small area and with resort to simple and compact wrapping or folding implements.

A further object of the invention is to provide a novel and improved machine for the packing of arrays of cigarettes or other products of the tobacco processing industry.

Another object of the invention is to provide a novel machine which can simultaneously pack plural sequences of block-shaped commodities in accordance with the above outlined method and by resorting to the above outlined apparatus.

An additional object of the invention is to provide a receptacle which is produced in accordance with the above outlined method and/or in the above outlined apparatus.

SUMMARY OF THE INVENTION

One feature of the present invention resides in the provision of a method of confining discrete substantially block-shaped commodities in discrete deformable blanks having a plurality of mutually foldable sections in the form of panels and flaps. The method comprises the steps of advancing successive commodities of a series of commodities along a first path to an assembling station, conveying successive blanks of a series of discrete blanks to the assembling station along a second path so that each blank reaching the assembling station assumes a predetermined position of alignment with a discrete commodity at such station, intermittently advancing successive commodities and the aligned blanks along a third path to a plurality of additional stations, and draping the blanks around the aligned commodities including folding at least some of the sections relative to each other in fewer than four stages each of which is carried out at a different one of the aforementioned stations.

The commodities can constitute at least substantially rectangular parallelepiped bodes. For example, each commodity can comprise a substantially rectangular parallelepiped array of rod-shaped smokers' products and an envelope of metallic foil which confines the array.

In accordance with a desirable feature of the improved method, the draping step is completed in two successive stages while the advancement of the commodities and of the aligned blanks along the third path is being interrupted at the respective stations.

The draping step can include folding selected sections of each of the blanks relative to each other and against he respective commodities. As a rule, each blank comprises more than four sections (for example, well in excess of ten sections), and the draping step can include folding all but four sections of each blank against the respective commodity.

In accordance with a presently preferred embodiment of the method, the aforementioned first, second and third paths are at least substantially horizontal, and at least two of these paths are disposed at different levels. The arrangement is or can be such that the first and second paths include portions which overlap each other at the assembling station, and the third path is coplanar with one of the first and second paths, preferably with the second path. The draping step can include moving the blank or the commodity which is aligned therewith at the assembling station substantially vertically into the path of the commodity or the aligned blank.

At least the third path is preferably an arcuate path wherein the blanks and the aligned commodities are indexible about a vertical axis. The method can further comprise the step of evacuating the commodities and the blanks (which are then already draped around the respective commodities) at least substantially radially of and from the third path.

The method can also comprise the step of folding one of the plurality of foldable sections relative to the other sections prior to the step of conveying the respective blanks toward the assembling station, and the conveying step then preferably includes maintaining the blanks in an orientation such that the one section of the blank being conveyed toward the assembling station confronts the aforementioned vertical axis. The first path can be located at a level above the second path, at least at the assembling station, and the aforementioned step of moving the blank or the commodity at the assembling station substantially vertically then preferably includes moving the blank upwardly and simultaneously folding at least one other section of the moving blank upwardly.

The draping step can include folding all but a predetermined number of sections of each blank against the respective commodities, and the method can comprise the additional step of coating the predetermined number of sections with an adhesive upon completion of the draping step. If the third path is a circular path, the coating step preferably includes moving successive draped blanks at least substantially radially of such circular path.

The panels of each blank can include a bottom panel, a front panel and a top panel, and the additional stations can include a folding station immediately following the assembling station (as seen in the direction of advancement of commodities and blanks along the third path), and the draping step can include folding the bottom, front and top panels toward the respective commodities in a predetermined sequence at the folding station. The arrangement is or can be such that the folding of the front panels precedes the folding of the top panels but follows the folding of the bottom panels. The flaps of each panel can include a pair of bottom flaps flanking the respective bottom panel, and the draping step can further comprise folding and urging the bottom flaps against the respective commodities during folding of the respective bottom and front panels and terminating the urging step prior to folding of the respective top panel. The step of folding the bottom and front panels can include folding such panels upwardly.

The flaps of each blank can include first, second and third pairs of flaps which respectively flank the rear, top and bottom panels of the respective blank. If the first path is located at a level above the second path, the draping step can include lifting a blank at the assembling station against the respective commodity, simultaneously folding the pairs of flaps relative to the respective panels, thereafter lowering the blank and the respective commodity at the assembling station from the first path into the second path, and simultaneously folding the top panel, the first pair of flaps and the third pair of flaps against the respective commodity.

Another feature of the present invention resides in the provision of an apparatus for confining discrete substantially block-shaped commodities in discrete deformable blanks having a plurality of mutually foldable sections in the form of panels or flaps. The improved apparatus comprises means for advancing successive commodities of a seres of discrete commodities along a first path to an assembling station, means for conveying successive blanks of a series of blanks to the assembling station in a predetermined direction along a second path so that each blank reaching the assembling station assumes a predetermined position of alignment with a commodity at the assembling station, means for intermittently advancing successive commodities and aligned blanks along a third path from the assembling station to a plurality of successive additional stations, and means for draping the blanks around the aligned commodities, including means for folding at least some of the sections relative to each other in fewer than four stages each of which is carried out at a different one of the aforementioned stations.

Each commodity can comprise a block-shaped array of articles and an envelope for the array of articles. The articles can constitute rod-shaped smokers' products.

The at least some sections which are folded in fewer than four stages can include the panels and predetermined flaps of each blank.

The stations of the aforementioned plurality of successive additional stations can include a first additional station and a second additional station, and the draping means can be provided at the assembling station as well as at the first additional station. The apparatus can further comprise means for evacuating successive commodities and the respective draped blanks from the third path at the second additional station, and means for introducing successive blanks into the second path at a further station located ahead of the assembling station as seen counter to the predetermined direction.

The means for advancing successive commodities to the assembling station can comprise a first turntable which is indexible about a first vertical axis, and the means for conveying successive blanks to the assembling station can comprise a second turntable which is indexible about a second vertical axis and is overlapped by the first turntable at the assembling station. The second turntable preferably defines the second and third paths. The first turntable can be provided with first pockets for advancement of discrete commodities to the assembling station, and the second turntable can be provided with second pockets for reception of discrete commodities from the first pockets at the assembling station. The second pockets are preferably provided with outlets to permit evacuation of commodities and the respective draped blanks by the aforementioned evacuating means at the second additional station, i.e., from the third path.

The second turntable is or can be provided with at least one platform or an analogous support for reception of blanks at the further station and for conveying the thus received blanks to the assembling station. Each blank can include an end section, and such end sections are preferably folded not later than at the further station and confront the second axis (of the second tuntable) during conveying of blanks by the at least one platform from the further station to the assembling station.

The second turntable can further comprise means for confining the blanks to preselected positions relative to the at least one platform during conveying of blanks from the further station to the assembling station. Such confining means can include means (such as suction ports connected to a suction generating device) for pneumatically coupling the blanks to the at least one platform and/or mechanical retainer means on the second turntable.

The second turntable can further comprise projections which constitute abutments for predetermined flaps of blanks which are being conveyed from the further station to the assembling station.

The draping means can comprise at least one pusher which is disposed at the assembling station and is movable vertically upwardly to move at least one first section of the blank at the assembling station against the commodity in the first pocket at the assembling station. Still further, such draping means can comprise a folding member which is movable vertically with and relative to the at least one pusher to fold at least one second section of the blank at the assembling station relative to the commodity in the first pocket at the assembling station. The folding member can be provided with at least one projection which serves to deform at least one third section of a blank at the assembling station.

Still further, the just outlined draping means can comprise a second pusher which is disposed above the at least one pusher and is movable with the at least one pusher vertically downwardly to transfer a commodity from a first pocket at the assembling station into the registering second pocket at such assembling station.

The draping means can further comprise guide means for the blanks at the assembling station; such guide means is preferably arranged to share at least some movements of the at least one pusher and/or the second pusher.

Still further, the draping means can comprise mobile lateral holders for selected sections (such as flaps) of blanks on the second turntable.

The draping means can also comprise additional folding members which are disposed at the first additional station and serve to fold selected sections of successive blanks. One of the additional folding members is preferably located beneath the third path and includes a pivotable first folding head. Another of the additional folding members at the first additional station is preferably located above the third path and includes two folding heads which are rotatable about a predetermined axis. The one additional folding member comprises a retainer for a section of the blank at the first additional station.

The evacuating means can comprise a conveyor which is arranged to advance draped commodities away from the third path along an at least substantially straight fourth path at least substantially radially of the second axis.

The novel features which are considered as characteristic of the invention are set forth in particular in the appended claims. The improved apparatus itself, however, both as to its construction and its mode of operation, together with additional important and advantageous features thereof, will be best understood upon perusal of the following detailed description of certain presently preferred specific embodiments with reference to the accompanying drawings.

BRIEF DESCRIPTION OF THE DRAWINGS

FIG. 5*a* is a plan view of a blank as it appears prior to folding of any of its sections;

FIG. 5*b* is a perspective view of a blank as it appears in the position shown in FIG. 2*a* or 2*b;*

DESCRIPTION OF PREFERRED EMBODIMENTS

Figure 5C:
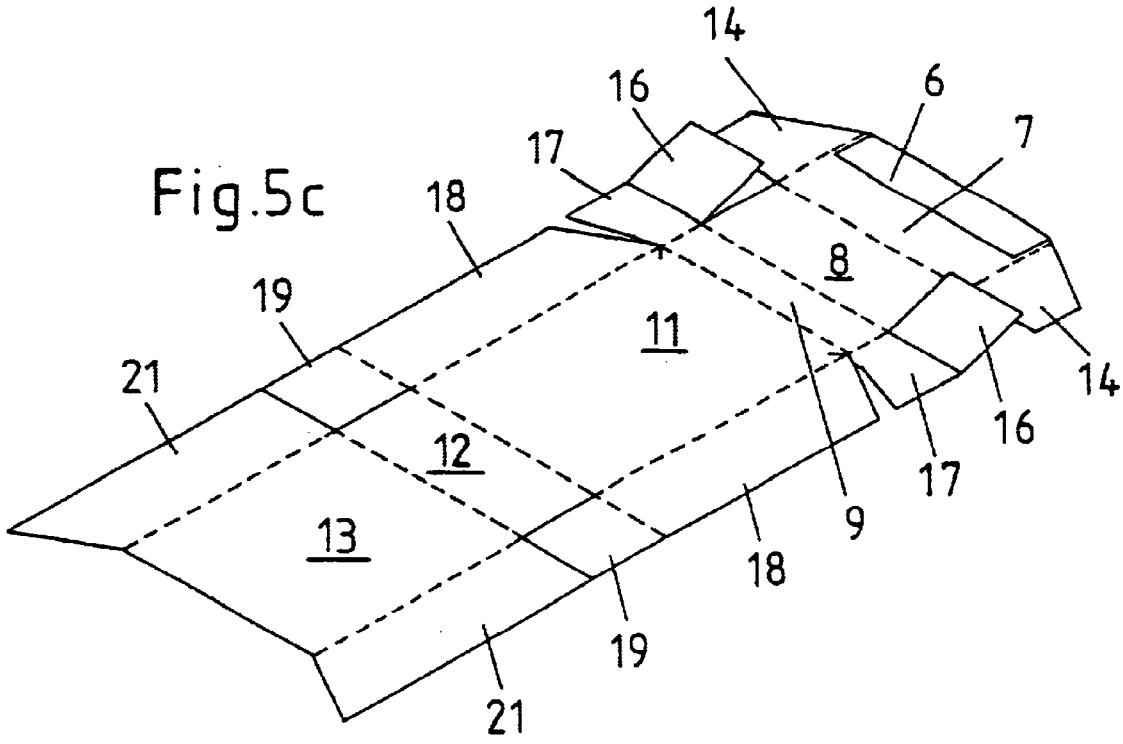
FIG. 5*c* is a perspective view of a blank as it appears upon treatment by the vertically movable folding member of FIGS. 2*c* and 2*d;*

Referring first to FIG. 5*a*, there is shown a blank 1 which can be made of cardboard and is to be converted into a hinged-lid packet for confinement of a block-shaped commodity 4 (FIG. 2*b*) including an array of cigarettes and an envelope 2 of metallic foil. A finished packet further comprises a substantially U-shaped insert 3 (FIG. 2*b*) of the type fully described and shown in the aforementioned commonly owned copending patent application Ser. No. 08/780,744.

Figure 2A:
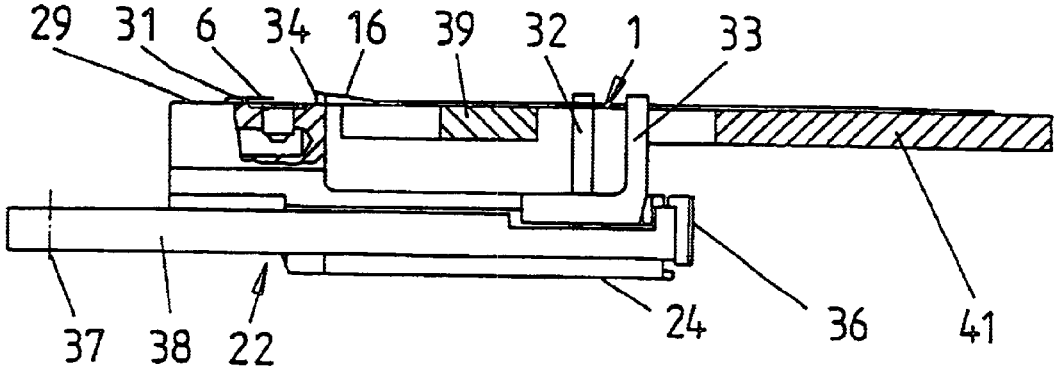
FIG. 2*a* is an enlarged fragmentary sectional view as seen in the direction of arrows from the line A—A in FIG. 1 and shows a blank on the platform of one of the turntables preparatory to indexing of the one turntable in order to convey the blank to the assembling station.

The blank 1 of FIG. 2*a* comprises a plurality of sections 6–9, 11–14, 16–19 and 21 including a centrally located row of panels 6–9 and 11–13 as well as pairs of flaps 14, 16, 17, 18, 19, 21 respectively flanking the panels 7, 8, 9, 11, 12, 13. The panel 6 constitutes an inner panel of the lid, the panel 7 constitutes the front panel of the lid, the panel 8 the top panel of the lid, and the panel 9 the rear panel of the lid. The panel 11 constitutes the rear panel or wall of the main portion, the panel 12 the bottom panel or wall, and the panel 13 the front panel or wall of the main portion of the finished packet.

The flaps 14 are to be glued to the respective flaps 17 to constitute the lateral walls of the finished lid, and the flaps 21 are to be glued to the respective flaps 18 to constitute the end panels or walls of the finished main portion of the packet. The flaps 19 are actually tucks between the respective pairs of flaps 18, 21, and the flaps 16 are folded against the inner side of the top panel 8 of the finished lid.

The broken lines indicate in FIGS. 5*a* to 5*i* those fold lines which are provided in a blank prior to conversion of such blank into a packet. The solid lines between neighboring panels indicate the locations of cuts or slits between such neighboring sections of a blank 1. For example, and referring again to FIG. 5*a*, the panel 6 is pivotally connected with the adjacent panel 7 by a preformed fold line, the panel 7 is pivotally connected with the panel 8 and with the flaps 14 by preformed fold lines, the flaps 14 are not connected with the neighboring flaps 16, and so forth.

Figure 1:
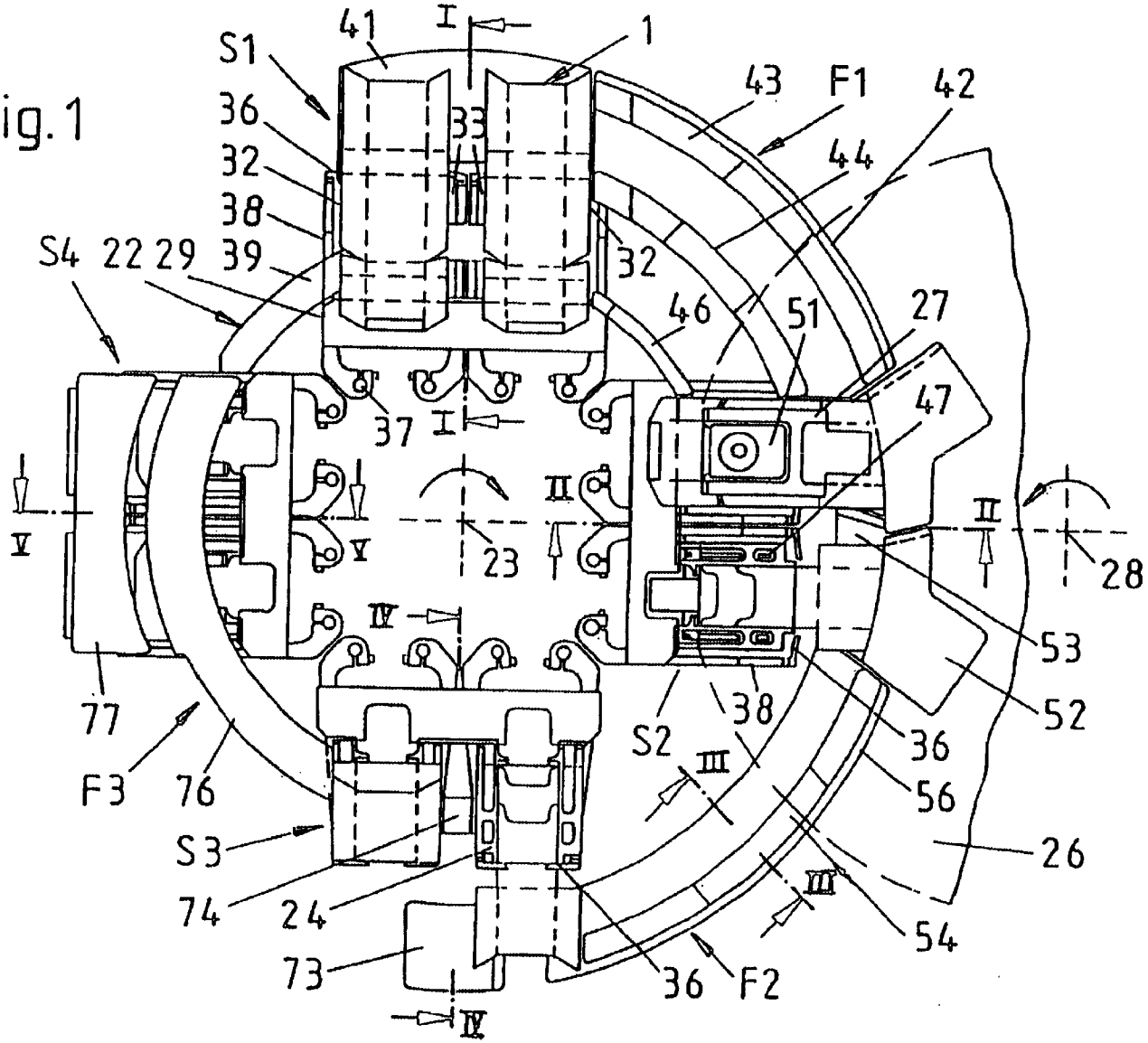
FIG. 1 is a fragmentary plan view of a twin-track cigarette packing machine with two apparatus embodying the present invention.

The apparatus which is shown in FIG. 1 forms part of a twin-track cigarette packing machine. This apparatus comprises a first turntable 26 which is indexible about a vertical axis 28 and serves to advance succesive pairs of block-shaped commodities 4 (namely two series of such commodities) from a source (not shown) to an assembling station S2. To this end, the turntable 26 is provided with pairs of equidistant pockets 27 (one shown in detail in FIG. 2*b*) for discrete commodities 4.

A second turntable 22 is indexible about a second vertical axis 23 and is provided with equidistant pairs of pockets 24 each adapted to receive a commodity 4. The turntable 22 is indexible in a clockwise direction, as viewed in FIG. 1, and the turntable 26 can be indexed clockwise or counterclockwise. All that counts is that two commodities 4, freshly delivered by the turntable 26, register with two pockets 24 of the turntable 22 at the station S2 when the two turntables are brought to a halt. The turntable 26 is assumed to be provided with four equidistant pairs of pockets 27, and the turntable 22 is also provided with four equidistant pairs of pockets 24.

A portion of the turntable 26 overlies a portion of the turntable 22 at the assembling station S2, and the turntable 22 defines a (third) horizontal path (including the arcuate portions F2 and F3) for joint advancement of pairs of commodities 4 (each of which overlies a discrete blank 1). The path including the portions F2 and F3 extends through a first additional station S3 and a second additional station S4. A further station Si is provided upstream (ahead) of the station S2 (as seen counter to the direction of conveying successive pairs of blanks 1 from the station S1 (i.e., along a second path F1) and ito the third path F2+F3 which latter is coplanar with the path F1). A first path, for advancement of pairs of commodities 4 to the assembling station S2, is defined by the turntable 26 at a horizontal level above the common horizontal level of the second and third paths F1 and F2+F3.

Figure 2B:
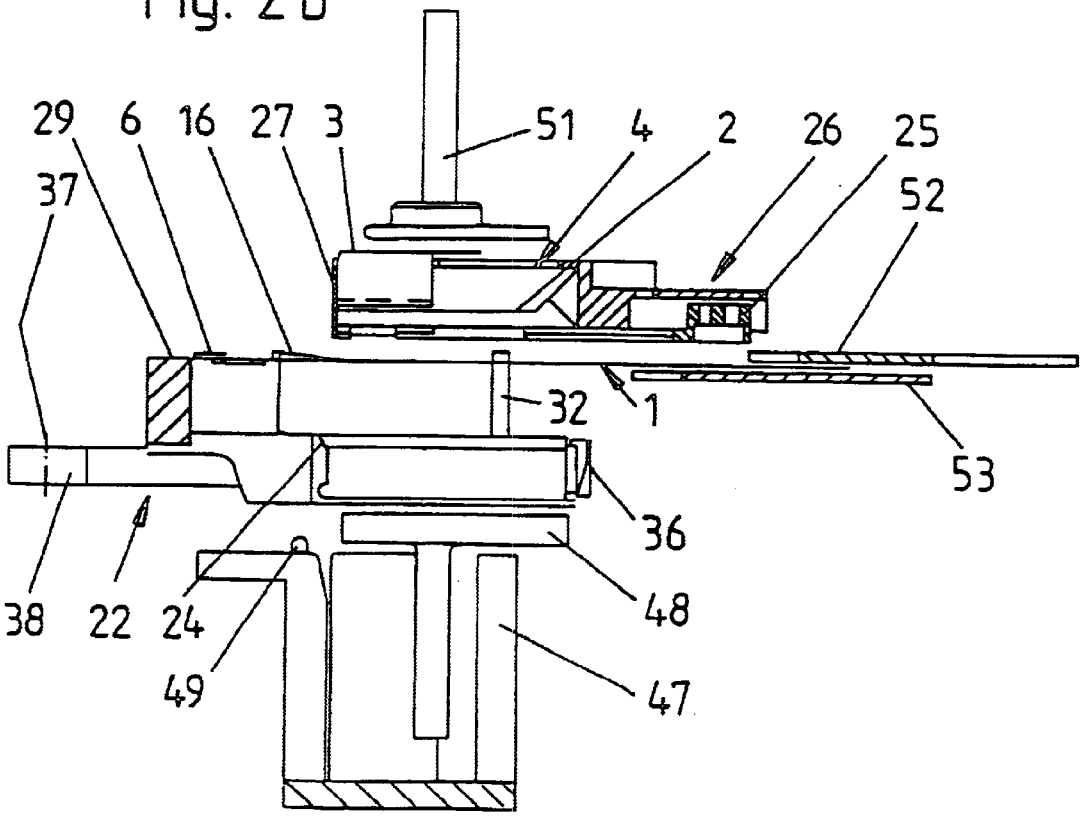
FIG. 2*b* is an enlarged fragmentary vertical sectional view as seen in the direction of arrows from the line B—B of FIG. 1 and shows a blank in a position of vertical alignment with a commodity in a pocket of the other turntable which overlies the one turntable at the assembling station.

As can be seen in FIG. 2*b*, the pockets 27 of the turntable 26 are open from below so that they can readily accept discrete commodities 4. The turntable 26 cooperates with reciprocable slides or gates 25 which can be moved between the extended (operative) positions (FIGS. 2*b* and 2*c*) to retain commodities in the respective pockets 27, and the retracted (inoperative) positions of FIG. 2*d* or 2*e* in which the commodities 4 can be expelled from the respective pockets 27 (at the assembling station S2) to enter the registering pockets 24 of the turntable 22.

The manner in which the pairs of identical blanks 1 (with their panels 6 already folded over or under the adjoining panels 7 in a manner as shown in FIGS. 5*b* to 5*h*) are fed onto a horizontal platform 29 (or onto one of four discrete platforms 29) at the upper side of the turntable 22 forms no part of the present invention. All that counts is that, in order to carry out the conversion of discrete blanks 1 into packets for the respective commodities 4 in accordance with one presently preferred embodiment of the improved method, the blanks 1 which are delivered at the station S1 come to rest on the platform 29 (or on the respective platforms 29) in such a way that their overlapping (already folded) panels 6 confront the vertical axis 23 and continue to confront such axis during conveying along the arcuate horizontal first path F1 from the station S1 to the assembling station S2.

The turntable 22 is further provided with means for confining pairs of neighboring blanks 1 to preselected positions relative to the platform 29 (or the respective platforms 29). For the sake of simplicity, it will be assumed that the turntable 22 is provided with a discrete platform for each pair of blanks 1 thereon, i.e., with one platform for each pair of pockets 24. The confining means comprises suction ports 31, i.e., means for pneumatically coupling the blanks 1 to the respective platforms 29, and mechanical retainer means 32, 33 carried by the turntable 22 and maintaining the blanks 1 in predetermined orientations relative to the axis 23 (see the blanks 1 at the twelve o'clock position of the turntable 22 in FIG. 1). Each blank 1 on its platform 29 is atracted to the turntable 22 by suction in the respective port or ports 31, and such blank is confined between the neighboring mechanical retainers 32, 33 at the station F1, during conveying along the second path F1, and at least in part during conveying along the third path F2+F3.

Each platform 29 is further provided with a pair of strip-shaped raised portions or projections 34 for the pairs of flaps 16 on the overlying blank 1 (see FIGS. 2*a* and 5*b*). Furthermore, the turntable 22 carries pairs of mobile lateral holders 36, one pair for each pocket 24, mounted on levers or arms 38 which are pivotable about the axes of vertical shafts 37.

The turntable 22 is indexible relative to stationary radially inner and outer guides 39 and 41 (see, for example, FIGS. 1 and 2*a*) which stabilize the blanks 1 during conveying along the second path F1, i.e., from the station S1 toward the station S2. As can be seen in FIG. 2*a*, a blank 1 which shares the movement of the turntable 22 to be conveyed from the station S1 to the station S2 includes portions which overlie the guides 39 and 41.

The positions of the pairs of blanks 1 which are being conveyed from the station S1 to the station S2 are further controlled by a stationary lower guide 42 and stationary upper guides 43, 44, 45 (FIG. 1). These guides can be said to flank the second path F1 along which the blanks 1 are caused to advance from the station S1 to the assembling station S2.

Two vertically movable folding members 47 of the means for draping blanks 1 around the respective commodities 4 are provided at the assembling station S2, one for each of two pockets 24 or 27 which are located at the station S2 while the turntables 22, 26 are at a standstill. Each folding member 47 is movable up and down with as well as relative to a lower pusher 48, and each member 47 is provided with a projection 49. The folding members 47 and the associated pushers 48 are movable through the pockets 24 and upwardly beyond, the levels of the platforms 29 of the lower turntable 22 (see FIG. 2*c*).

Each lower pusher 48 registers with an upper pusher 51 which is movable (with and relative to the respective lower pusher 48) between a raised position (FIGS. 2*c*, 2*d*, 2*f*) above the turntable 26 and a lowered position (FIG. 2*e*) beneath the turntable 26. The pushers 51 are movable through the pockets 27 at the assembling station S2 and serve to ensure predictable transfer of commodities 4 from the pockets 27 into the (then) registering pockets 24.

The characters 52 and, 53 (see FIGS. 1 and 2*b* to 2*f*) denote vertically movable (auxiliary) guides for the blanks 1 at the assembling station S2. These guides are mounted in such a way that they share the vertical movements of the lower folding member 47 and lower pusher 48. The guides 52, 53 overlie each other and define a narrow gap for portions of the blanks 1 at the assembling station S2.

The portion F2 of the third path (for joint movement of commodities 4 and the respective blanks 1) between the stations S2 and S3 is flanked by an upper guide 54 and a lower guide 56.

Additional folding members 58 and 61 (best shown in FIGS. 3*a* to 3*e* and 4) are provided at the station S3 to carry out additional folding or draping operations. In accordance with a desirable feature of the present invention, folding or draping of blanks 1 (i.e., the conversion of such blanks ito packets for the respective commodities 4) can be completed in two successive stages at two stations S2 and S3. The only presently preferred exception is that the panels 6 are caused to overlie or underlie the neighboring panels 7 at or even ahead of the station S1, i.e., upstream of the assembling station S2. Another presently preferred exception will be described with reference to FIG. 5*i*.

The folding member 58 of FIGS. 3*a* to 3*e* and 4 is located at a level below the third path F2+F3 and includes a folding head 68 designed to advance along a relatively complex path 57 (denoted by dotted lines) in order to pivot or fold selected sections of a blank 1 at the station S3. The upper folding member 61 is located at a level above the path F2+F3 and is mounted for angular movement about the axis of a horizontal shaft 59. This upper folding member 61 comprises two folding heads 71, 72 which are located substantially diametrically opposite each other with reference to the axis of the shaft 59.

Figure 4:
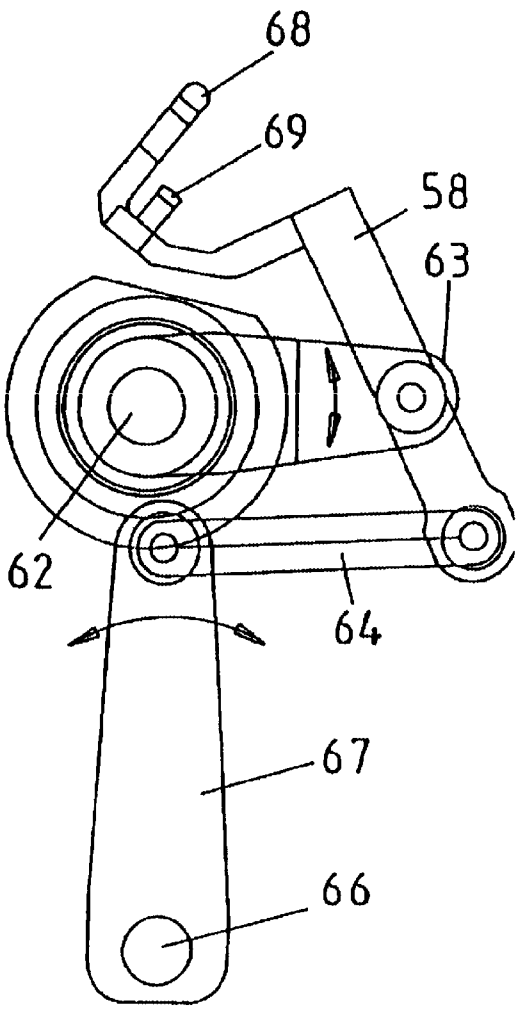
FIG. 4 is an elevational view of a mechanism which synchronizes the movements of the folding members shown in FIGS. 3*a* to 3*e;*

As can be seen in FIG. 4, the means for causing the folding head 68 of the lower folding member 58 to advance along the path 57 includes a lever 63 which is pivotable back and forth about the fixed axis of a shaft 62 and which is pivotably connected with the folding member 58 so that the latter can be pivoted relative to the lever 63 by a link 64 which receives motion from the free end of a lever 67 pivotable about the axis of a fixed shaft 66. The folding member 59 is further provided with a retainer 69 which is adjacent the folding head 68.

The means for moving the folding members 47, 58, 61, the pushers 48, 51 and certain other mobile components of the draping or folding means in a predetermined sequence includes a set of suitable cams, not shown.

Referring again to FIG. 1, the apparatus further comprises a stationary guide 73 at a level below and stationary upper guides 74, 76, 77 at a level above the portion F3 of the third path. These guides control the orientation of the (draped) blanks 1 on their way from the station S3 to the station S4. The latter station serves for the transfer of packets from the turntable 22 onto a conveyor 78 which advances the packets radially of the third path F2+F3 to a further station and preferably past one or more devices serving to apply a suitable adhesive to the flaps 18 and/or 21 and to the flap 14 in order to allow for a completion of conversion of the blanks 1 into finished packets completely surrounding the respective commodities 4 and each including a main portion with panels or walls 11–13 and a lid including the panels 6–9 and being pivotally affixed to the main portion along the fold line between the panels 9 and 11.

The apparatus of FIG. 1 can be utilized for the practice of our improved method in the following way:

The turntable 22 is at a standstill when two of its platforms 29 are located at the station S1 to accept discrete blanks 1 of the type shown in FIG. 5*a* but with the panels 6 already folded relative to the adjacent panels 7 (as shown, for example, in FIG. 2*b*). The overlapping panels 6,7 of each of the two freshly deposited or delivered blanks 1 confront the vertical axis 23 of the turntable 22. The blanks 1 are attracted to the respective platforms 29 by suction in the corresponding ports 31 and are maintained in desired orientation by the respective pairs of confining means or retainers 32, 33 on the turntable 22. The positions of the projections or protuberances 34 on the platforms 29 are such that these projections maintain the respective flaps 16 in slightly inclined positions (see FIS. 2*a* and 2*b* and the partially deformed blank 1 of FIG. 5*b*). The inclination of the flaps 16 is such that they extend into spaces subsequently defined by the finished packets (converted blanks 1).

The next step involves an indexing of the turntable 22 about the vertical axis 23 in order to convey the two blanks 1 from the station S1 to the assembling (first folding or draping) station S2. Indexing of the turntable 22 about the axis 23 may but need not take place simultaneously with indexing of the turntable 26 about the vertical axis 28; all that counts is to ensure that each freshly delivered blank 1 at the station S2 assumes a predetermined position relative to one of the commodities 4 advanced by the turntable 26 which latter overlies the turntable 22 at the station S2 (see FIG. 2*b*). Each commodity 4 comprises an array of (for example, twenty) cigarettes, a preferably metallic envelope 2 for the array, and a U-shaped collar 3 surrounding a predetermined portion of the envelope. Each of the two pockets 24 at the station S2 is in register (a position of vertical alignment) with one of the two pockets 27 in the turntable 26, i.e., with one of the two commodities 4 then located at the station S2.

The panels 11 of the blanks 1 at the station S2 abut the undersides of the envelopes 2 forming part of the registering commodities 4. The collars 3 overlie the respective envelopes 2 and each of the two pockets 27 at the station S2 overlies one of the two pockets 24 forming part of the lower turntable 22.

Figure 2C:
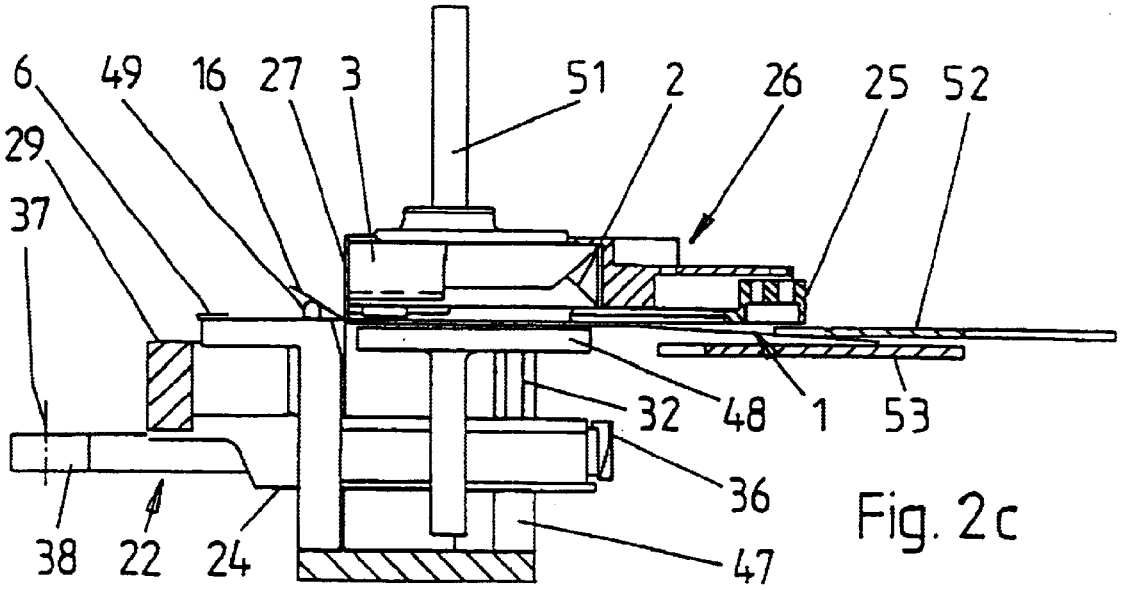
FIG. 2*c* shows the structure of FIG. 2*b* but with the blank lifted against the underside of the commodity in the pocket of the other turntable.

As shown in FIG. 2*c*, the next step of the method involves a joint upward movement of the folding members 47 and the lower pushers 48 while the blanks 1 and the registering commodities 4 are still located at the assembling (first folding) station S2. At the same time, the upper pushers 51 are caused to descend onto the adjacent portions of the respective envelopes 2. These upper pushers engage and depress the respective U-shaped collars 3 into firm engagement with the top walls of the respective envelopes 2. At the same time, the projections 49 of the folding members 47 cause a further pivoting of the respective flaps 16 (compare FIGS. 5*b* and 5*c*).

Figure 2D:
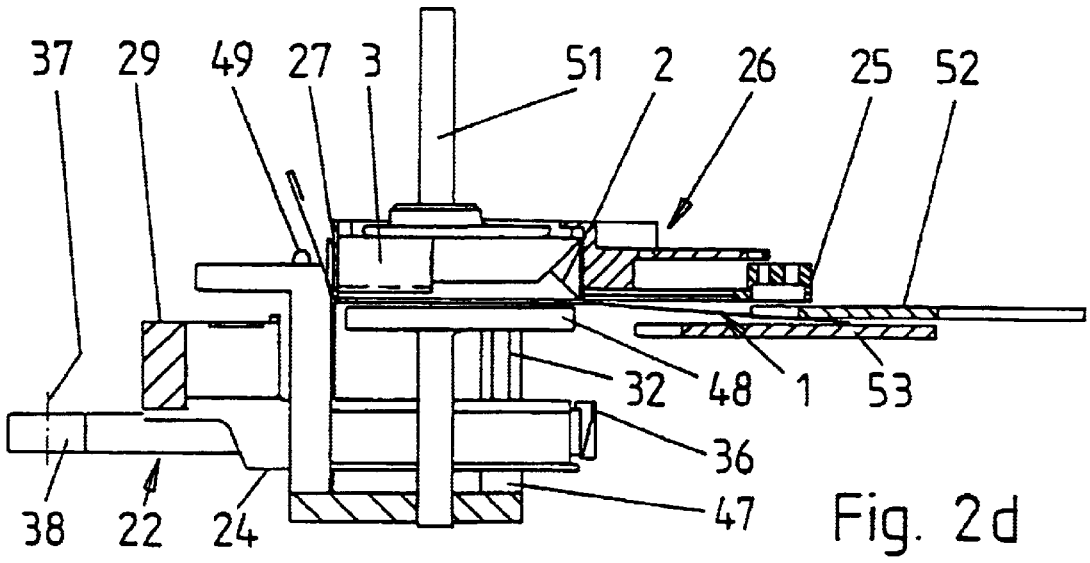
FIG. 2*d* shows the structure of FIG. 2*c* but with a vertically movable folding member in a raised position.
Figure 5D:
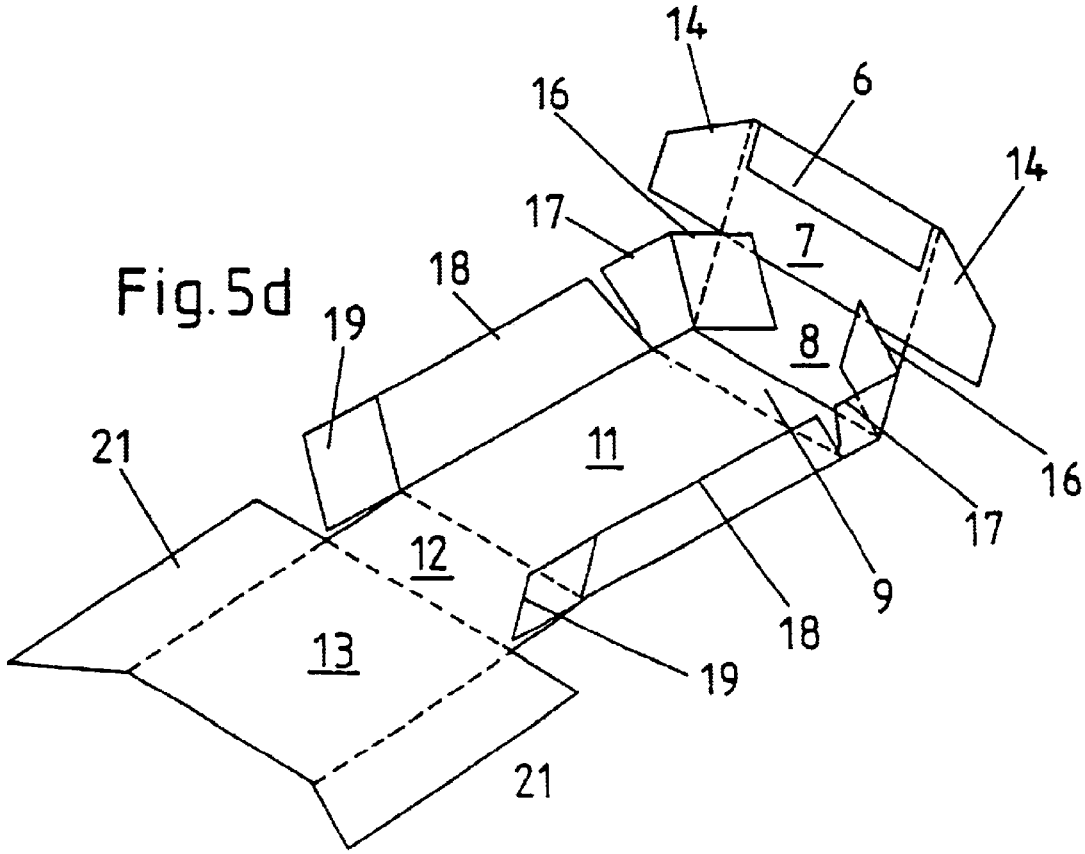
FIG. 5*d* is a perspective view of a blank as it appears upon additional deformation by the vertically movable folding member.

FIG. 2*d* shows that each folding member 47 then moves upwardly relative to the adjacent lower pusher 48 which entails additional draping or folding of each blank 1 at the station S2. FIG. 5*d* shows that such upward movement of a folding member 47 entails a further pivoting of the flaps 16 relative to the respective panels 8 as well as a pivoting of the panels 7, 8 and flaps 17, 18, 19. In effecting such pivoting or folding of at least some of the just enumerated panels and flaps, the rising folding member 47 cooperates with the surfaces bounding the respective pocket 27 in the turntable 26.

As shown in FIG. 2*d*, the slide 25 is retracted so that the underside of the envelope 2 in the corresponding pocket 27 can be engaged by the corresponding lower pusher 48 because the underside of the pocket 27 is readily accessible in its entirety as soon as the member 25 is moved from the position of FIG. 2*c* to that which is shown in FIG. 2*d*.

Figure 2E:
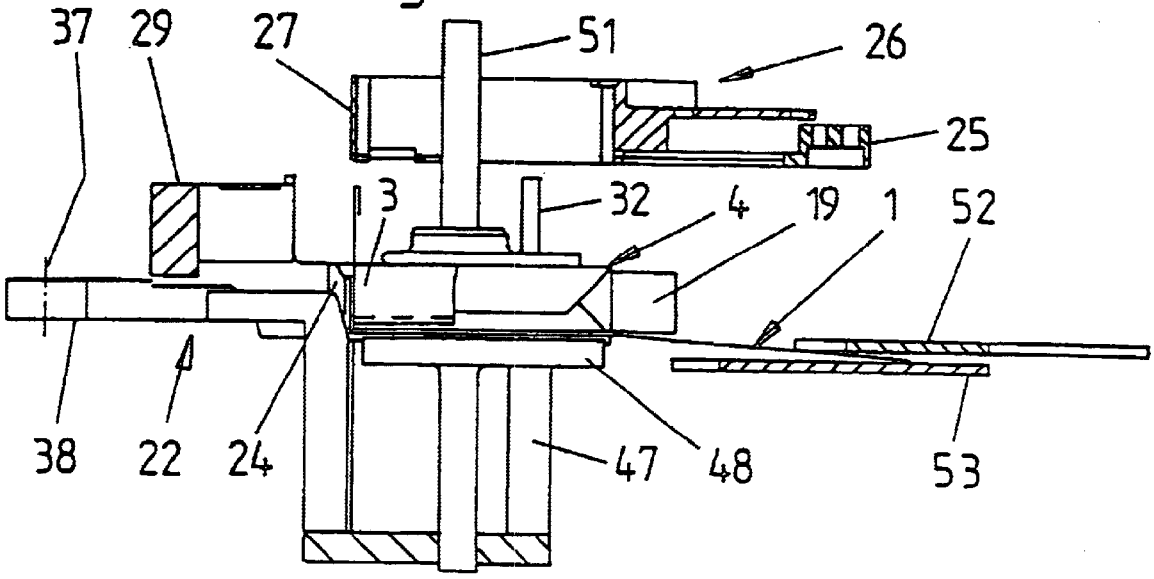
FIG. 2*e* shows the structure of FIG. 2*d* but with the commodity lowered into a pocket of the one turntable.
Figure 2F:
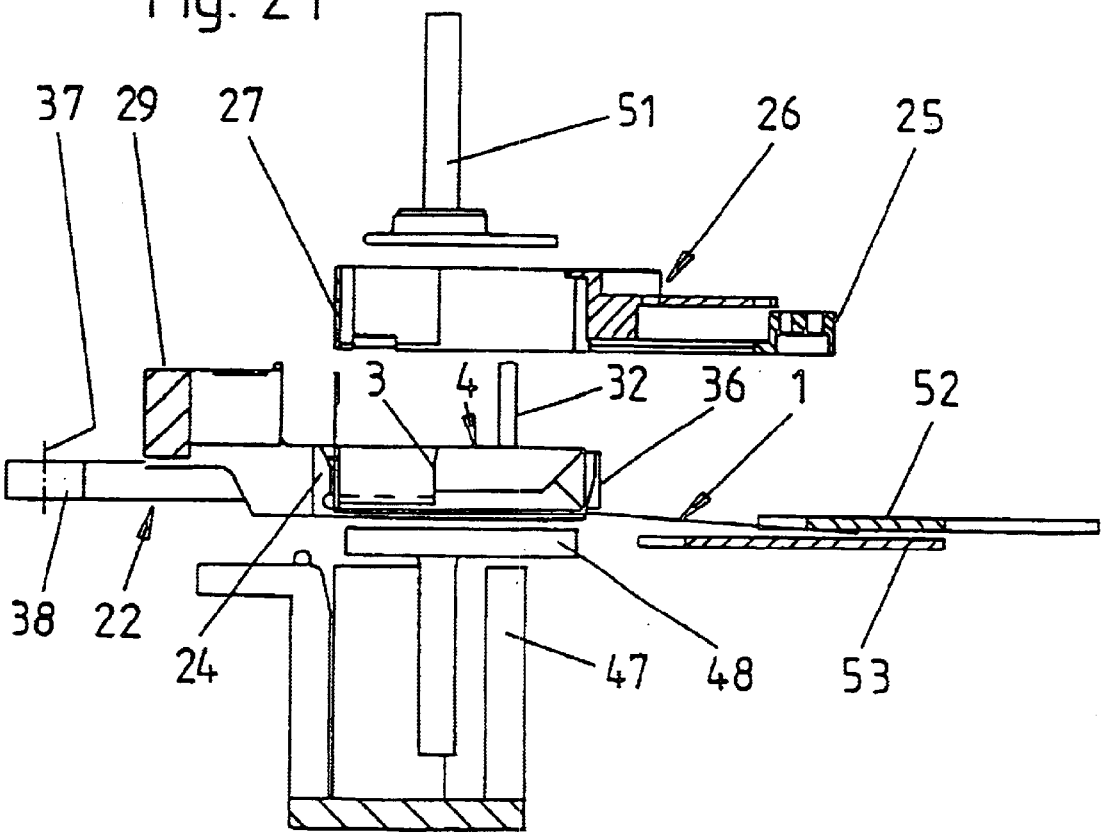
FIG. 2*f* shows the structure of FIG. 2*e* but during a further stage of draping of the blank at the assembling station.

FIG. 2*e* shows the next step which involves a joint movement of the illustrated pushers 48, 51 vertically downwardly to thus transfer the blank 1 and the commodity between them from the pocket 27 of the upper turntable 26 into the registering pocket 24 of the lower turntable 22. This entails additional pivoting of certain panels and flaps (compare FIGS. 5*d* and 5*e*) to positions at right angles to certain neighboring panels and flaps. The guide members 52, 53 share such downward movements of the pushers 48, 51 to maintain the blank portion between them in a desired position, i.e., to move the panel 13 and the flaps 21 downwardly with the adjacent panel 12.

Figure 5E:
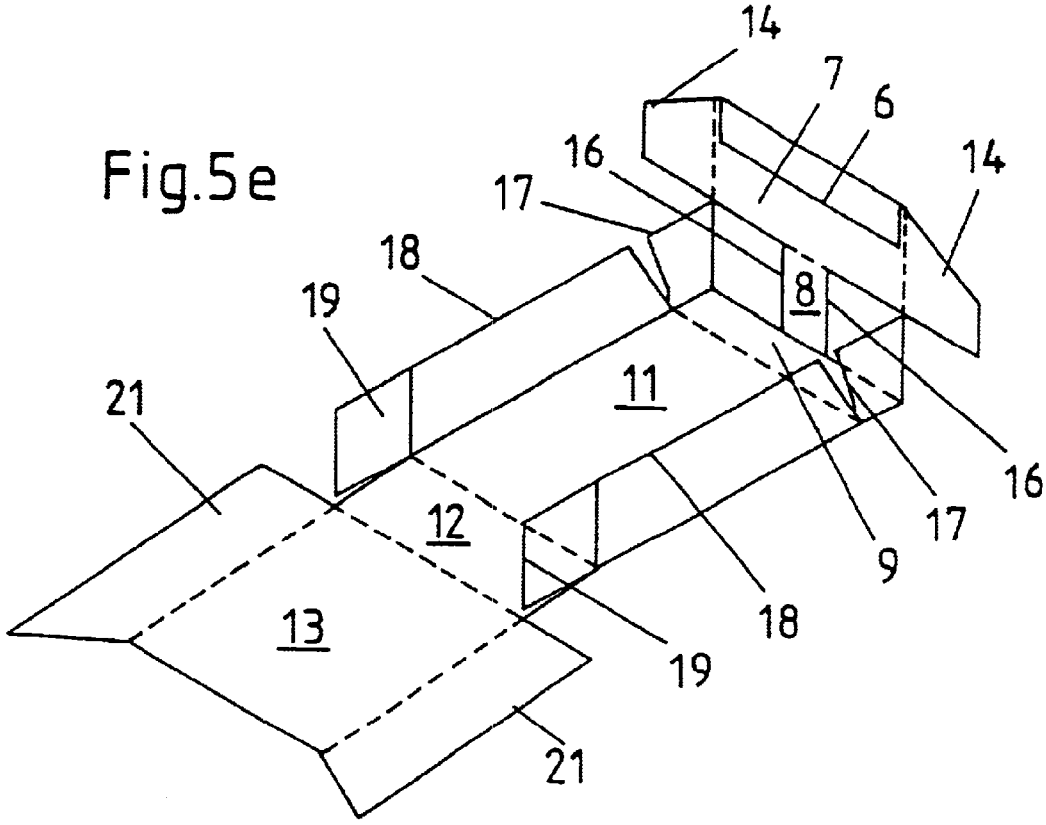
FIG. 5*e* is a perspective view of a blank as it appears upon downward movement of the aligned commodity from the position of FIG. 2*f* to the position shown in FIG. 2*g;*
Figure 5F:
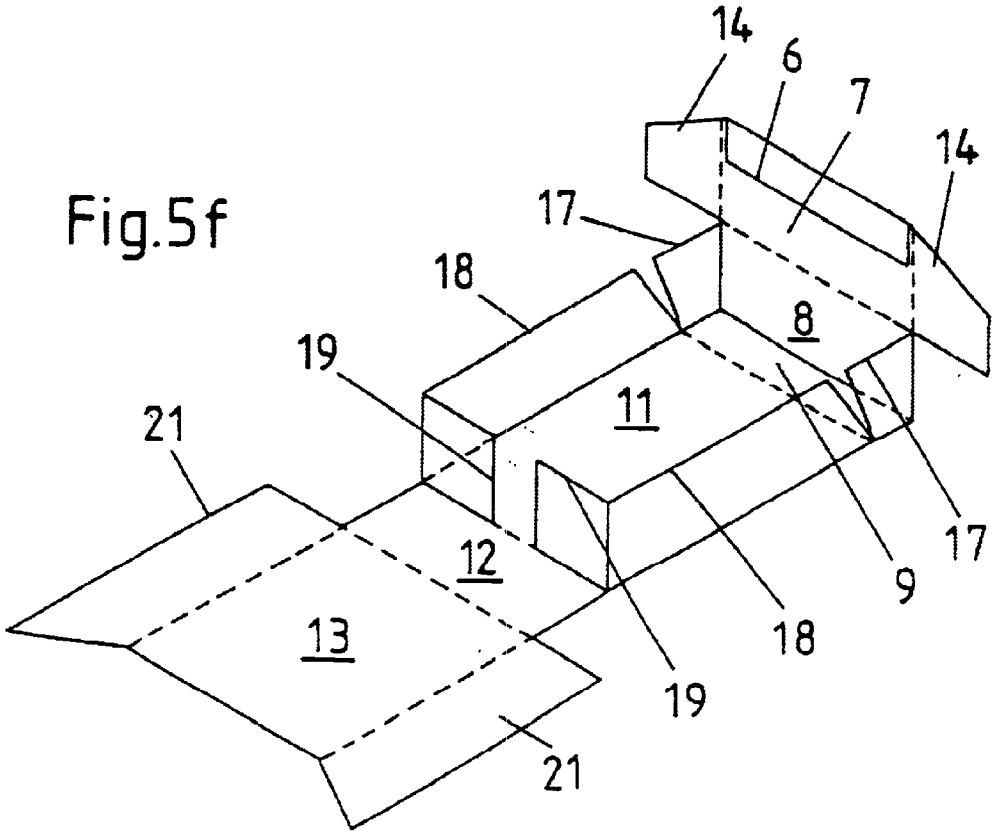
FIG. 5*f* is a perspective view of the blank upon completion of a further folding step.

The lateral holders 36 are pivoted by their levers 38 from the retracted positions to their operative positions (FIG. 2*f*) to thereby pivot the flaps 19 from the positions of FIG. 5*e* to the positions of FIG. 5*f*, namely against the adjacent portions of the envelope 2.

Figure 2G:
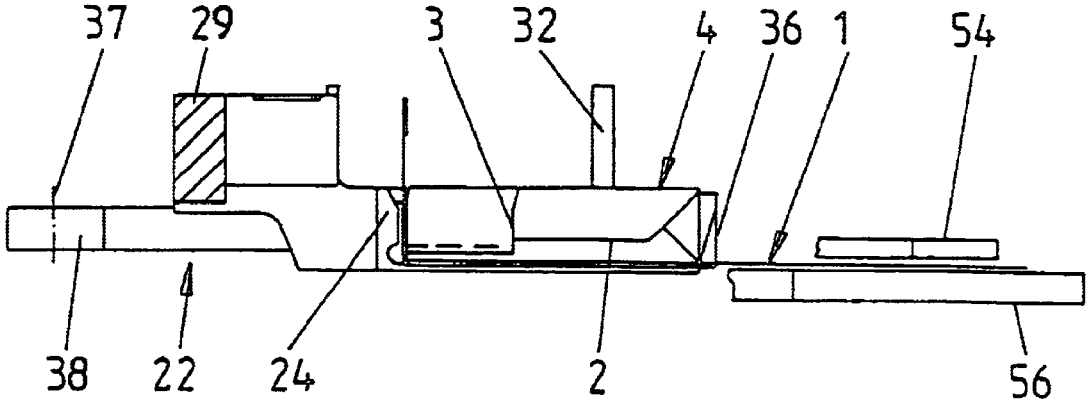
FIG. 2*g* is an enlarged fragmentary vertical sectional view substantially as seen in the direction of arrows from the line C—C of FIG. 1, with a partly finished packet and the respective commodity in an arcuate third path leading to first and second additional stations.
Figure 2H:
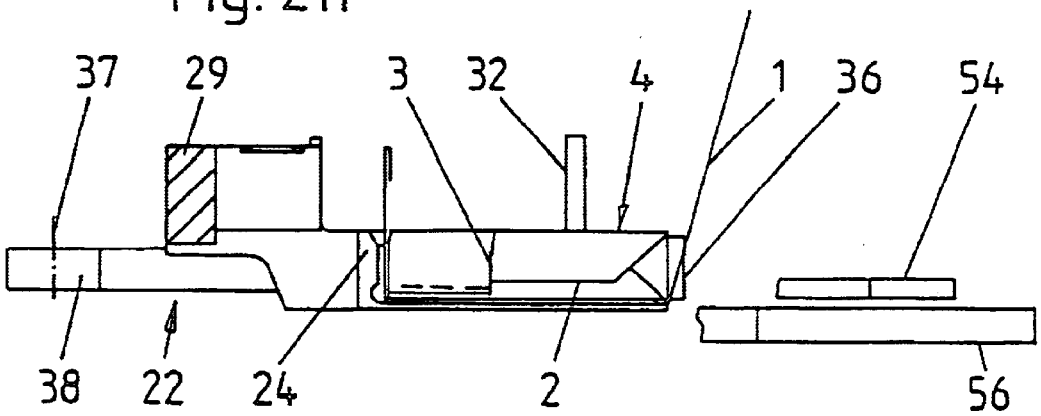
FIG. 2*h* is an enlarged fragmentary vertical sectional view substantially as seen in the direction of arrows from the line D—D of FIG. 1, with the partly finished packet and the respective commodity at the first additional station.

The next step involves retraction of the folding member 47 and of the two pushers 48, 51 to their inoperative positions so that the turntable 22 can be indexed by a step (through 90 degrees) in order to advance (see FIG. 2*g*) the pair of partially draped blanks 1 and the respective commodities 4 along the path portion F2, i.e., from the assembling station S2 to the station S3. During such indexing of the turntable 22, portions of the two blanks 1 which have previously occupied the station S2 advance between the guides 54, 56 and to the positions shown (for one of the parts 1 plus 4) in FIG. 2*h*. The lower folding member 58 then pivots the panels 12, 13 (see FIG. 5*g*); this involves a pivoting of the folding member 58 from the positon of FIG. 3*a* to and somewhat beyond that which is shown in FIG. 3*b*. At such time, the two lateral holders 36 serve as complementary folding members in that they cooperate with the folding member 58 to pivot the panels 12, 13 to the positions shown in FIG. 5*g*.

Figure 3C:
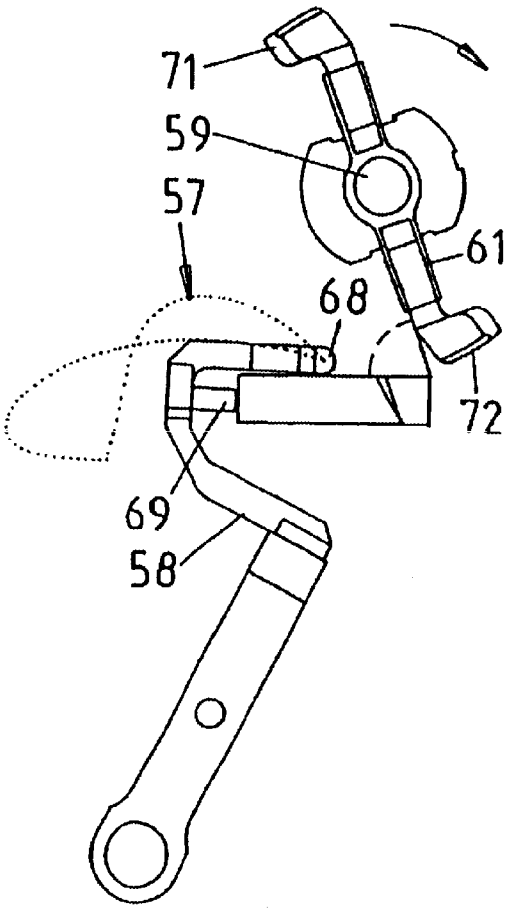
FIG. 3*c* shows the structure of FIG. 3*b* but with both folding members in different angular positions.
Figure 3B:
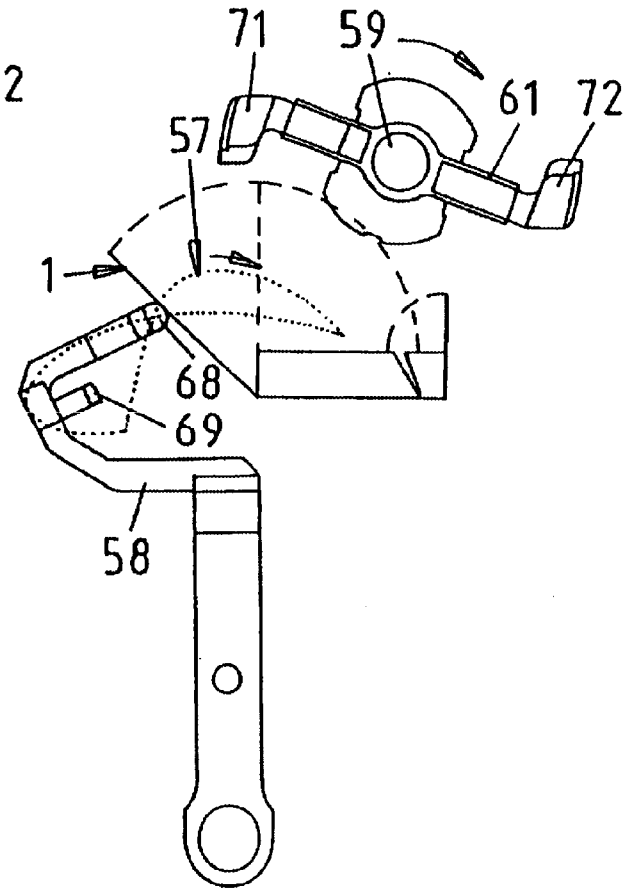
FIG. 3*b* shows the structure of FIG. 3*a* but with the lower folding member in a different angular position.
Figure 3A:
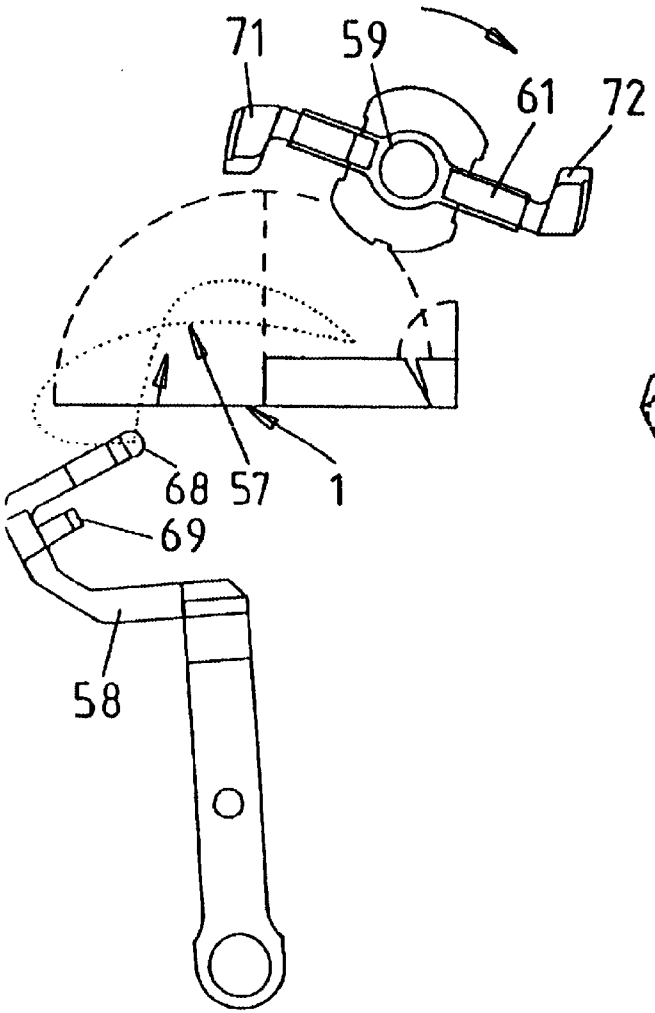
FIG. 3*a* is an elevational view of two folding members which are provided at the first additional station to fold selected sections of partially converted blanks while such blanks are temporarily arrested during advancement along the third path on toward the evacuating conveyor.
Figure 5G:
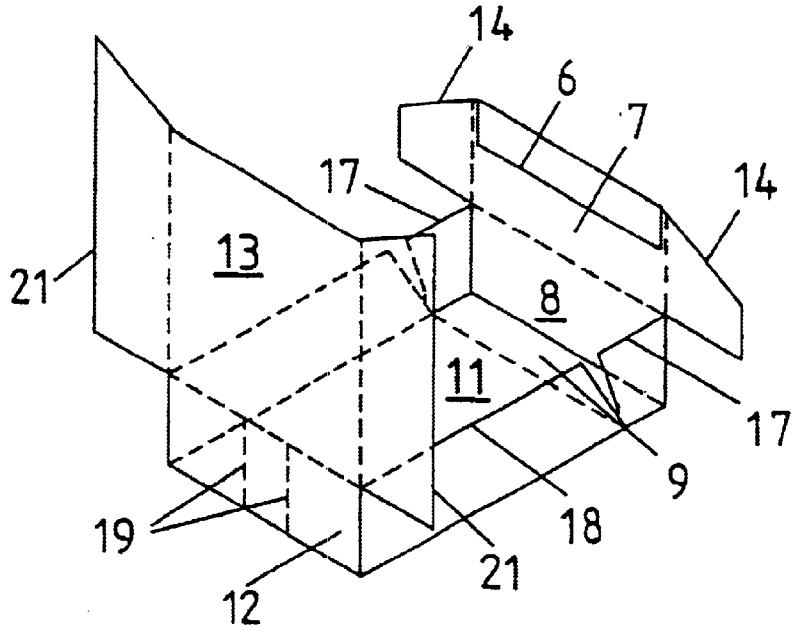
FIG. 5*g* is a perspective view of a blank upon completion of a further folding step, namely by the lower folding member of FIGS. 3*a* to 3*e;*
Figure 5H:
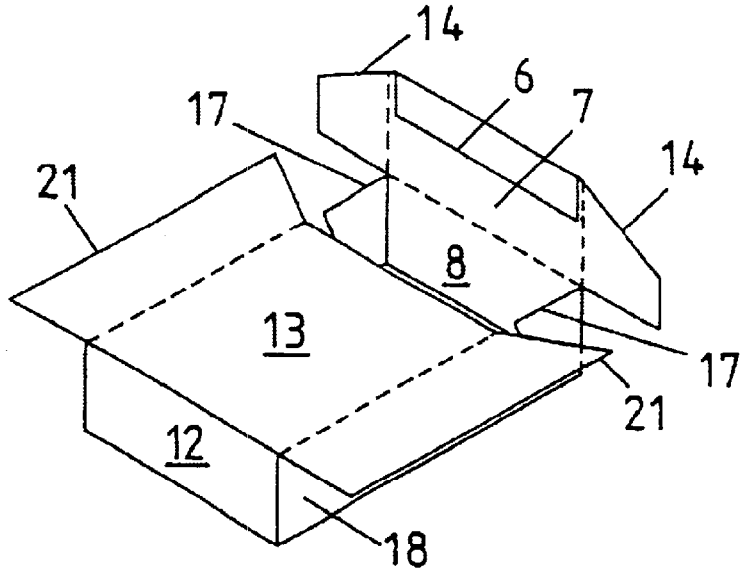
FIG. 5*h* is a perspective view of a blank upon additional treatment by the lower folding member of FIGS. 3*a* to 3*e*.
Figure 5I:
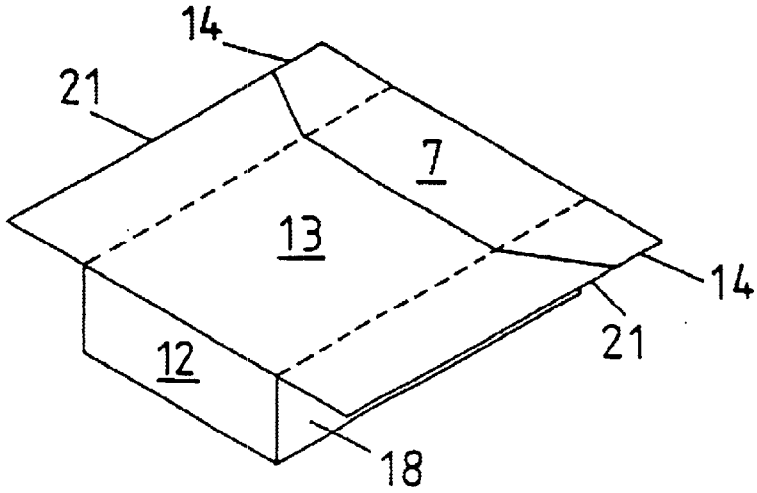
FIG. 5*i* is a perspective view of a blank as it appears upon treatment by the upper folding member of FIGS. 3*a* to 3*e* and is ready to be evacuated from the third path at the second additional station.

The next step involves a retraction of the lateral holders 36 and a further pivoting of the lower folding member 58 from the position of FIG. 3*b* to that which is shown in FIG. 3*c* so that the panel 13 is pivoted relative to the panel 12 from the position of FIG. 5*g* to that which is shown in FIG. 5*i*. The retainer 69 of the folding member 58 then abuts the panel 12 (see FIGS. 3*c* and 5*h*).

Figure 2I:
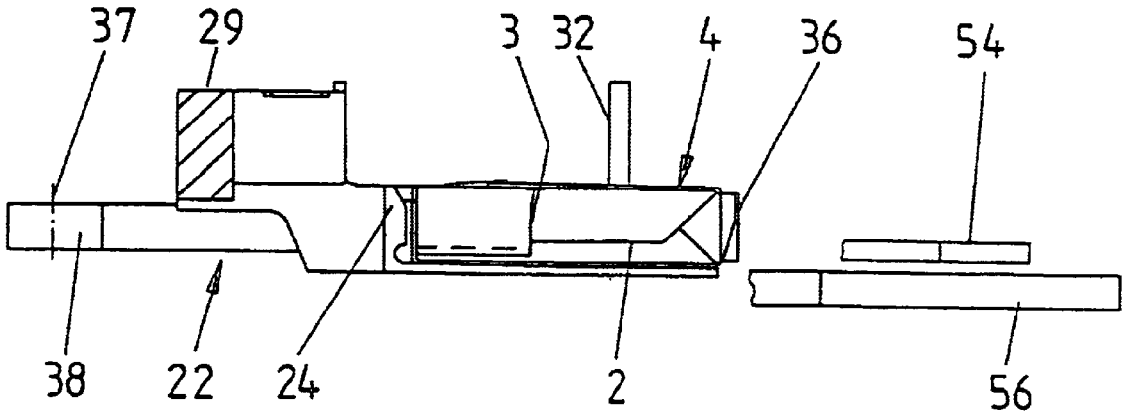
FIG. 2*i* illustrates the structure of FIG. 2*h* but with the blank shown during a further stage of conversion into a packet.
Figure 3E:
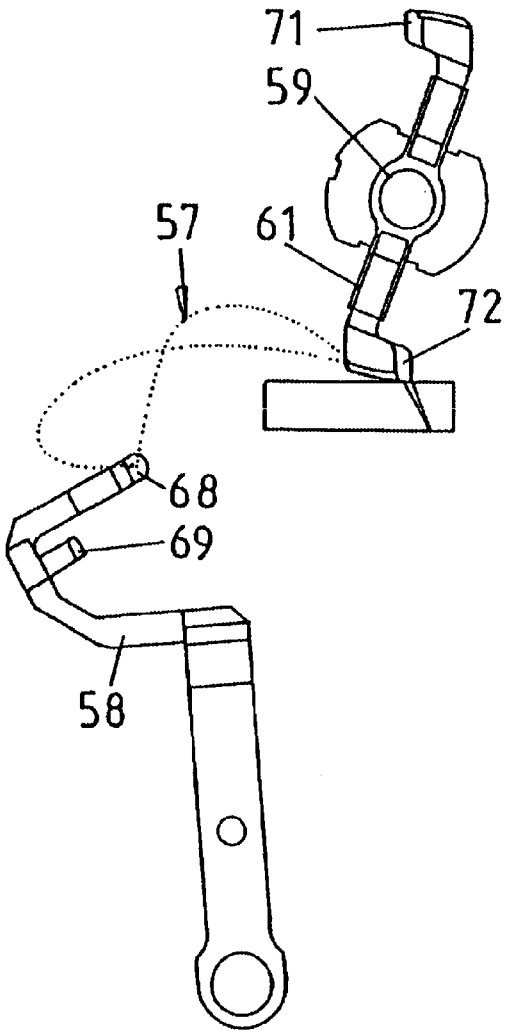
FIG. 3*e* shows the structure of FIG. 3*d* but with both folding members in different angular positions.
Figure 3D:
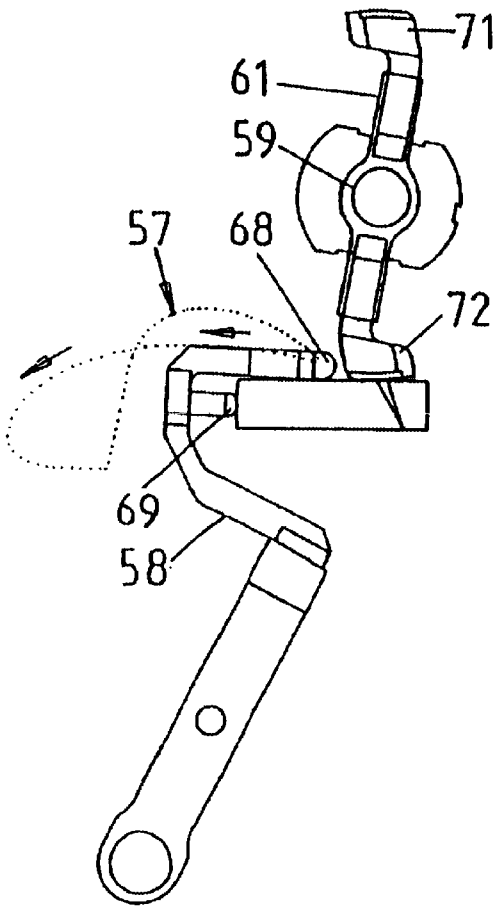
FIG. 3*d* shows the structure of FIG. 3*c* but with the upper folding member in a different angular position.

The lateral holders 36 then reassume their operative positions (FIG. 2*i*) and the upper folding member 61 is pivoted so that its head 72 folds the panel 7 (compare FIGS. 3*c* and 3*d* and refer also to FIG. 5*i*). The folding member 58 is then pivoted from the operative position of FIG. 3*d* to the retracted position of FIG. 3*e* but the panels 7 and 13 are held in the final positions of FIG. 5*i* by the head 72 of the folding member 61 (see FIG. 3*e*).

The turntable 22 is indexed again, and the guides 76, 77 ensure that the condition of the nearly finished packets does not change during advancement along the path portion F3 from the station S3 to the evacuating station S4. The folding member 61 is caused to turn through 180° in response to each indexing of the turntable 22.

Figure 2J:
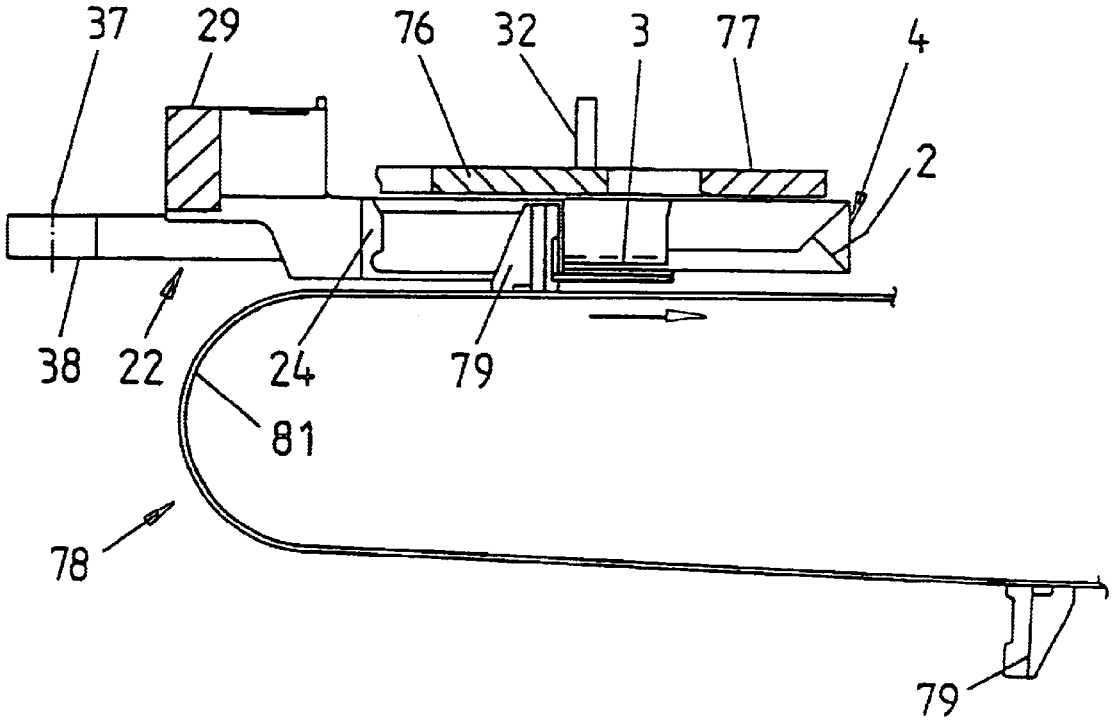
FIG. 2*j* is an enlarged fragmentary vertical sectional view substantially as seen in the direction of arrows from the line E—E in FIG. 1 and shows a finished packet at the second additional station in the range of an evacuating conveyor.

The pairs of flaps 14 and 21 extend laterally from the respective panels 7 and 13 (i.e., they are at least substantially coplanar with the respective panels 7 and 13) when they reach the station S4. As shown in FIG. 2*j*, the teeth 79 of the endless belt or band 81 of the evacuating conveyor 78 then engage the two packets and move them radially of the arcuate path F2+F3 away from the axis 23. As already mentioned above, those sides of the pockets 24 which face radially outwardly at the station S4 are open to ensure that the belt 81 can expel the nearly finished packets from such pockets and advance them past or to one or more stations where the sections 18 and/or 21 as well as 14 and/or 17 are coated with a suitable adhesive (e.g., hotmelt) prior to folding of the flaps 12, 14 over the adjacent flaps 18, 17 to thus complete the conversion of blanks 1 into hinged-lid packets each of which contains a commodity 4.

An important advantage of the improved method and apparatus is that the major part of conversion of successive blanks 1 (or successive pairs of blanks as actually shown in FIG. 1) can be completed in a small area (basically at only two stations S2 and S3) which contributes to compactness of the packing machine.

In addition, the appearance of each of a short or long series of successive packets is the same which is attributable to accurate guidance of the blanks during conveying or advancement to and from successive stations as well as at such stations.

Furthermore, at least one (22) of the turntables not only serves to advance the blanks and partly finished packets to and beyond successive folding stations S2, S3 but such turntable cooperates with certain draping or folding instrumentalities to actually fold or to assist in the folding of selected sections of the blanks.

An additional important advantage of the improved method and apparatus is that they can be resorted to in single-track or multiple-track packing machines and that the apparatus can be equipped with simple, compact and versatile draping or packing or folding implements which can reliably fold the sections of successive blanks at designated locations and at a high or very high frequency.

The turntable 22 can be small or relatively small because it need not advance successive blanks to a large number of different stations. Thus, and as shown in FIG. 1, it suffices to provide a total of not more than four stations of which the foremost serves for delivery of blanks to the turntable (if the blanks are not delivered to the turntable 22 directly at the station S2), the next serves to accept the commodities and for the carrying out of several blank folding or converting operations, the third serves to complete the contemplated folding operations, and the last serves for the evacuation or expulsion of practically finished packets from the apparatus.

Still another advantage of the improved method and apparatus is that the preferably horizontal plane for the pockets 27 of the upper turntable 26 can be placed in close or very close proximity to the preferably horizontal plane for the pockets 24 of the lower turntable 22. This renders it possible to complete the transfer of commodities 4 from the pockets 27 at the station S2 into the registering pockets 24 within extremely short intervals of time which contributes to higher output of the packing machine and reduces the likelihood of undesirable deformation (such as unfolding or opening) of partially deformed blanks during dwell at the station S2. Savings in space are especially important in multiple-track packing machnes.

Initial folding of the flaps 16 in a manner as shown in FIGS. 2*a* and 2*c* is optional but desirable and advantageous because it contributes to more predictable further or additional folding of these flaps in a manner as shown in FIGS. 5*d* and 5*e*.

The lifting of the blanks 1 off the platforms 29 and pivoting of selected sections into the adjacent pockets 27 (FIG. 2*c*) prior to joint lowering of the blanks and the respective commodities 4 into the registering lower pockets 24 (at the station S2 or S3) also contributes to more predictable and short-lasting conversion of blanks into packets of the type shown in FIG. 5*i*. Repeated folding (such as initial partial folding followed by final folding) of blank sections relative to each other contributes to greater predictability of conversion of blanks into packets having a predetermined optimum size and shape.

The provision of two pushers 48, 51 which are movable jointly as well as relative to each other is desirable and advantageous because this ensures predictable transfer (lowering) of commodities 4 from the pockets 27 into the registering pockets 24 as well as a predictable positioning and retention of the collars 3 in optimum posiitions relative to the respective envelopes 2.

The absence of one or more pasters in the improved apparatus also exhibits certain advantages. Thus, the apparatus is less likely to be contaminated by particles of tobacco, cardboard or other impurities.

The sequence of certain folding or draping steps at the station S2 and/or S3 can depart from the illustrated and described sequence without departing from the spirit of the invention. Moreover, the functions of certain folding or draping implements can be combined or split and certain operations which were described as being carried out at the station S2 can be performed at the station S3 and/or vice versa.

Still further, it is even possible to carry out one or more draping or folding operations at the station S1 or at the station S4, or to perform one or more adhesive applying steps not later than at the station 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating blanks for cigarette packets or the like and, therefore, such adaptations should and are intended to be comprehended within the meaning and range of equivalence of the appended claims.

What is claimed is:

1. Apparatus for confining discrete substantially block-shaped commodities in discrete deformable blanks having a plurality of mutually foldable sections in the form of panels and flaps, comprising:

means for advancing successive commodities of a series of commodities along a first path to an assembling station;

means for conveying successive blanks of a series of blanks to said assembling station in a predetermined direction and along a second path so that each blank reaching said assembling station assumes a predetermined position of alignment with a commodity at said station;

means for intermittently advancing successive commodities and aligned blanks along a third path from said assembling station to a plurality of successive additional stations; and means for draping said blanks around the aligned commodities, including means for folding at least some of said sections relative to each other in fewer than four stages each of which is carried out at a different one of said stations, wherein said stations of said plurality of successive additional stations include a first additional station and a second additional station, said draping means being provided at said assembling station and said first additional station and further comprising means for evacuating successive commodities and the respective draped blanks from said third path at said second additional station and means for introducing successive blanks into said second path at a further station located ahead of said assembling station as seen counter to said predetermined direction, and said means for advancing successive commodities to said assembling station comprises a first turntable indexible about a first vertical axis, said means for conveying successive blanks to said assembling station comprising a second turntable indexible about a second vertical axis and being overlapped by said first turntable at said assembling station, said second turntable defining said second and said third paths, wherein said first turntable has first pockets for advancement of discrete commodities to said assembling station and said second turntable has second pockets for reception of discrete commodities from first pockets at said assembling station, said second pockets having outlets for evacuation of commodities and the respective draped blanks by said evacuating means at said second additional station, wherein said second turntable has at least one platform for reception of blanks at said further station and for conveying the thus received blanks to said assembling station, and wherein said draping means comprises at least one pusher disposed at said assembling station and movable vertically upwardly to move at least one first section of the blank at said assembling station against the commodity in the first pocket at said assembling station, and a folding member movable vertically with and relative to said at least one pusher to fold at least one second section of the blank at said assembling station relative to the commodity in the first pocket at said assembling station.

2. The apparatus of claim 1, wherein said folding member comprises at least one projection arranged to deform at least one third section of a blank at said assembling station.

3. The apparatus of claim 1, wherein said draping means further comprises a second pusher disposed above said at least one pusher and movable with said at least one pusher vertically downwardly to transfer a commodity from a first pocket at said assembling station into the registering second pocket at said assembling station.

4. The apparatus of claim 1, wherein said draping means further comprises guide means for the blanks at said assembling station, said guide means being arranged to share at least some movements of said at least one pusher.

5. The apparatus of claim 1, wherein said draping means further comprises mobile lateral holders for selected sections of blanks on said second turntable.

6. The apparatus of claim 1, wherein said draping means further comprises additional folding members disposed at said first additional station and arranged to fold selected sections of successive blanks.

7. The apparatus of claim 6, wherein one of said additional folding members is located beneath said third path and includes a pivotable first folding head, another of said additional folding members being located above said third path and including two folding heads rotatable about a predetermined axis.

8. The apparatus of claim 7, wherein said one additional folding member comprises a retainer for a section of a blank at said first additional station.

* * * * *